US005606398A

United States Patent [19]

Ender

[11] Patent Number: 5,606,398

[45] Date of Patent: Feb. 25, 1997

[54] REDUCTION OF RESIDUAL POTENTIAL AND GHOSTING IN A PHOTOCONDUCTOR

[75] Inventor: David A. Ender, River Falls, Wis.

[73] Assignee: Minnesota Mining and Manufacturing Company, St. Paul, Minn.

[21] Appl. No.: 430,432

[22] Filed: Apr. 28, 1995

[51] Int. Cl.[6] ..... G03G 15/02

[52] U.S. Cl. ..... 399/168; 361/212; 361/214; 399/153

[58] Field of Search ..... 355/214, 218, 355/219, 220, 208; 361/212, 214, 220, 225

[56] References Cited

U.S. PATENT DOCUMENTS

| | | | |
|---|---|---|---|
| 4,170,413 | 10/1979 | Bayer | 355/218 |
| 4,244,646 | 1/1981 | Bayer et al. | 355/218 |
| 4,262,075 | 4/1981 | Noda et al. | 355/219 X |
| 4,413,897 | 11/1983 | Kohyama | 355/218 |
| 4,641,158 | 2/1987 | Takeuchi . | |
| 4,654,286 | 3/1987 | Tsujimoto et al. | 355/219 X |
| 4,669,854 | 6/1987 | Ichikawa et al. | 355/218 |
| 4,974,021 | 11/1990 | Takemoto | 355/218 X |
| 5,055,879 | 10/1991 | Bhagat | 361/225 X |
| 5,083,163 | 1/1992 | Brown et al. | 355/219 |
| 5,272,504 | 12/1993 | Omura et al. | 355/218 |
| 5,510,626 | 4/1996 | Nelson et al. | 250/591 |

FOREIGN PATENT DOCUMENTS

| | | | |
|---|---|---|---|
| 0271334 | 6/1988 | European Pat. Off. . | |
| 1958446 | 7/1970 | Germany | G03G 13/00 |
| 53-148444 | 12/1978 | Japan . | |
| 61-097667 | 5/1986 | Japan . | |

OTHER PUBLICATIONS

Berg, W. F. and Hauffe, K., "Current Problems in Electophotography", Walter de Gruyter, 1972, pp. 7–20.

Schaffert, R. M., "Special Topics", *Electrophotography,* The Focal Press, 1975, pp. 166–167.

Schaffert, R. M., "The Photodielectric Processes", *Electrophotography,* The Focal Press, 1975, pp. 105–113.

Scharfe, Merlin, *Electrophotography Principles and Optimization,* Research Studies Press Ltd., Letchworth, Hertfordshire, England, 1984, pp. 5–10.

Xerox Disclosure Journal, vol. 3, No. 6, Nov. 1978, Stamford, Conn, US.

Patent Abstracts of Japan, vol. 5, No. 175, Nov. 11, 1981, p. 88.

Patent Abstracts of Japan, vol. 10, No. 344, Nov. 20, 1986, p. 518.

Patent Abstracts of Japan, vol. 11, No. 9, Jan. 10, 1987, p. 534.

Pinsler et al., "Fatiguing Effects of SE–Based Photoconductors in Non–Impact Printers with Red or Infrared Light Sources", *The Society for Imaging Science and Technology,* Proceedings of the Third International Congress on Advances in Non–Impact Printing Technologies, Aug. 24–28, 1986.

*Primary Examiner*—Matthew S. Smith

*Attorney, Agent, or Firm*—Carolyn A. Bates; Steven J. Shumaker

[57] ABSTRACT

A system and method for reducing residual electrostatic potential and ghosting in a photoconductor alleviates the problems of low optical density and ghosting. A charge is applied to a surface of the photoconductor, and the photoconductor is exposed to conditioning radiation having wavelengths selected to release charge carriers from trap sites within the photoconductor. The applied charge establishes an electric field across the photoconductor. The released charge carriers are transported within the photoconductor under influence of the electric field to reduce residual electrostatic potential in the photoconductor. The resulting reduction in residual electrostatic potential increases optical density and eliminates ghosting problems. The system and method can be applied to existing electrophotography machines, and can be realized, at least in part, by adaptation of existing hardware present in such machines, thereby adding very little complexity, cost, size, or power consumption.

27 Claims, 8 Drawing Sheets

REDUCTION OF RESIDUAL POTENTIAL AND GHOSTING IN A PHOTOCONDUCTOR

FIELD OF THE INVENTION

The present invention relates to electrophotographic imaging and, more particularly, to techniques for reducing residual potential and ghosting in a photoconductor.

DISCUSSION OF RELATED ART

An electrophotographic imaging process involves the steps of applying a uniform surface charge to a photoconductor, and exposing the photoconductor to imaging radiation that discharges the photoconductor in selected areas to define a latent electrostatic image. The latent image is then developed by the deposition of a dry or liquid toner on the photoconductor surface. The toner electrostatically adheres to the imaged areas of the photoconductor to form a developed image that is transferred to an imaging substrate. The optical density of the deposited toner, and of the image transferred to the imaging substrate, is a function of the potential difference, or "contrast," between imaged and unimaged areas of the photoconductor. Thus, the degree of contrast depends on the difference between the surface charge potential initially applied to the photoconductor and the potential of the imaged areas after discharge.

To produce high contrast, and hence good optical density, the difference between the surface charge potential and the discharged potential in the imaged areas should be as high as possible. Unfortunately, the discharge process does not immediately reduce the surface charge potential to zero, but rather produces a residual electrostatic potential that limits the degree of contrast that can be achieved. The existence of the residual potential can be explained by examining the mechanics of the discharge process, which has two components: an initial, rapid discharge phase and a subsequent, gradual discharge phase. In the rapid discharge phase, the imaging radiation generates charge carriers that quickly neutralize the surface charge in imaged areas to lower the surface potential. However, a portion of the charge carriers becomes trapped within the photoconductor bulk, resulting in the maintenance of a residual potential in the imaged areas. Over time, a gradual discharge phase occurs, in which the residual potential slowly drops to zero as the trapped charge carriers are released by thermal excitation. Nevertheless, complete discharge may not occur until after the toner development stage of the electrophotographic cycle, and therefore may have no practical significance in achieving high contrast for toner deposition.

In addition to decreasing optical density, residual potential can also contribute to the appearance of undesirable "ghost" images in previously imaged areas of the photoconductor. A ghost image is any visible remnant of a previous image superimposed on a present image. The ghosting problem can result from a variety of mechanisms. One mechanism is the accumulation of trapped charge carriers in discharged areas over a series of imaging cycles that results in a "build-up" of residual electrostatic potential. The accumulation of trapped charge carriers leads to a higher residual potential in previously imaged areas of the photoconductor relative to previously unimaged areas. The accumulation of trapped charge carriers may also create space charge fields that decrease conductivity in the previously imaged areas. The presence of higher residual potentials and/or space charge fields acts as a nonuniformity that decreases optical density upon development, and produces ghost images in areas in which differences in residual potential or conductivity exist.

Many existing electrophotographic imaging systems have addressed the problems of residual potential and ghost imaging by the use of an erase lamp. An example of a typical erase lamp technique is described in Electrophotography Principles and Optimization, Merlin Scharfe, Research Studies Press, Letchworth, England, pages 5–9 (1975). The erase lamp treats the undesirable nonuniformities caused by residual potential and ghosting by illuminating the entire photoconductor with radiation having wavelengths selected to be near the absorption peak of the particular photoconductive material used. The erase lamp is positioned adjacent the photoconductor between the development stage and the charging stage of the electrophotographic system. The erase lamp generates charge carriers that flood the photoconductor, discharging any remaining surface charge and, in theory, erasing the previous latent image. In reality, however, the charge carriers generated by the erase lamp merely populate trap sites within the photoconductor in a uniform manner.

The use of an erase lamp has not been completely effective in eliminating ghost images and does not reduce residual potential. The uniform illumination by the erase lamp does not necessarily result in uniform preparation of the photoconductor for the next charge-expose cycle. Even if the undischarged surface potential is made uniform, residual potentials still may exist due to the presence of trapped carriers in the photoconductor bulk. Further, the uniform erase technique may actually result in an added accumulation of the newly-generated charge carriers in trap sites, thereby aggravating the residual potential problem already present over successive cycles. The unimaged areas of the photoconductor maintain a high surface potential that supports an electric field. The electric field is helpful to some degree in sweeping away the charge carriers generated by the erase lamp before they can become trapped. Thus, the use of an erase lamp may help to stabilize the residual potential in nonimaged areas over repeated cycling. In the areas discharged for imaging, however, the existing field is too weak to sweep away the newly-generated charge carriers. As a result, the charge carriers are trapped in the imaged areas, creating added residual potential relative to nonimaged areas. The added residual potential can both reduce optical density and contribute to ghosting over a number of cycles.

The erase lamp technique also fails to eliminate internal space-charge fields in the photoconductor bulk. The developed optical density not only depends on the difference in surface potentials between imaged and unimaged areas of the photoconductor, which determines the maximum development bias potential that can be applied, but also varies as a function of the effective electrical impedance of the photoconductor during development. Trapped charge carriers can create space charge fields that are not measurable by the surface potential, but which nevertheless adversely affect the impedance of the photoconductor in imaged areas. The effective impedance in the imaged areas limits the amount of toner than can be deposited during development, producing visible ghosting problems.

Although the use of an erase lamp is somewhat effective in achieving uniformity of surface and bulk charge in the photoconductor, as discussed above, this technique fails to eliminate important sources of low optical density and ghosting, i.e., internal residual potential and space-charge fields. As a result, the output of existing electrophotographic systems continues to be less than desirable for high-quality imaging applications. Accordingly, there exists a need for a technique that reduces residual potential in a electrophotographic system, thereby alleviating the problems of low optical density and ghosting.

SUMMARY OF THE INVENTION

The present invention is directed to a system and method that alleviate the problems of low optical density and ghosting by reducing residual electrostatic potential in a photoconductor. As broadly embodied and described herein, the system and method of the present invention apply a charge to a surface of the photoconductor, and expose the photoconductor to conditioning radiation having wavelengths selected to release charge carriers from trap sites distributed within the photoconductor. The applied charge establishes an electric field across the photoconductor. The released charge carriers are transported within the photoconductor under influence of the electric field to reduce residual electrostatic potential in the photoconductor. The system and method of the present invention can be applied to both positively and negatively charging photoconductors. The system and method of the present invention also can be applied to existing electrophotography machines, and can be realized, at least in part, by adaptation of existing hardware present in such machines, thereby adding very little complexity, cost, size, or power consumption.

Additional features and advantages of the present invention will be set forth in part in the description that follows, and in part will be apparent from the description, or may be learned by practice of the present invention. The advantages of the present invention will be realized and attained by means particularly pointed out in the written description and claims hereof, as well as in the appended drawings.

It is to be understood that both the foregoing general description and the following detailed description are exemplary and explanatory only, and not restrictive of the present invention, as claimed.

BRIEF DESCRIPTION OF THE DRAWINGS

The accompanying drawings are included to provide a further understanding of the present invention and are incorporated in and constitute a part of this specification. The drawings illustrate exemplary embodiments of the present invention and together with the description serve to explain the principles of the invention.

DETAILED DESCRIPTION OF THE PREFERRED EMBODIMENTS

Figure 1:
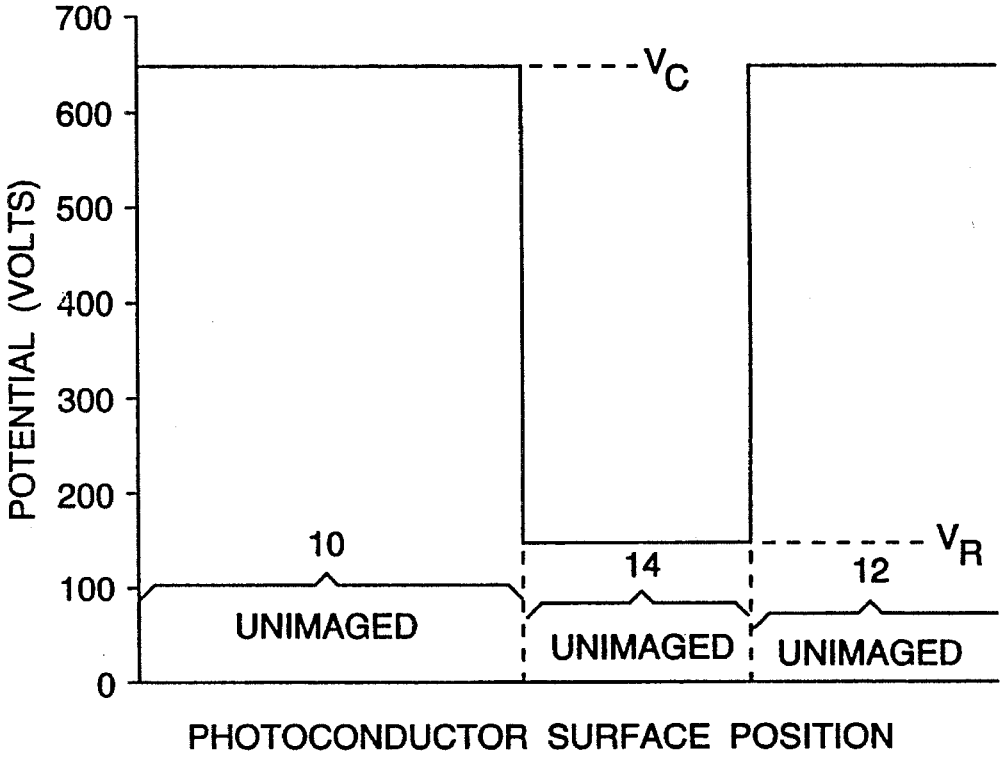
FIG. 1 is a simplified potential versus position plot of a photoconductor, illustrating the problem of residual potential.

FIG. 1 is a simplified plot of electrostatic potential over the surface of an imaged photoconductor, illustrating the problem of residual electrostatic potential. The plot represents the electrostatic potential in unimaged areas 10 and 12, relative to the electrostatic potential in an imaged area 14 that has been discharged by exposure to imaging radiation. The surface potential in the unimaged areas 10, 12 remains at a charged potential $V_C$ of, for example, six-hundred and fifty (650) volts, as established by a scorotron or other charging device. Upon exposure, the surface potential in imaged area 14 should ideally drop from the charged potential $V_C$ to a discharged potential of zero. However, an accumulation of trapped charge carriers and/or the generation of space-charge fields within the photoconductor bulk prevents the potential from falling below a residual electrostatic potential $V_R$ in imaged area 14. The residual potential $V_R$, shown in FIG. 1 as approximately one-hundred and fifty (150) volts, undesirably limits the contrast that can be achieved between the discharge potential and a development bias potential applied during subsequent toner development of imaged area 14. The limited contrast results in reduced optical density in the developed image.

Figure 2:
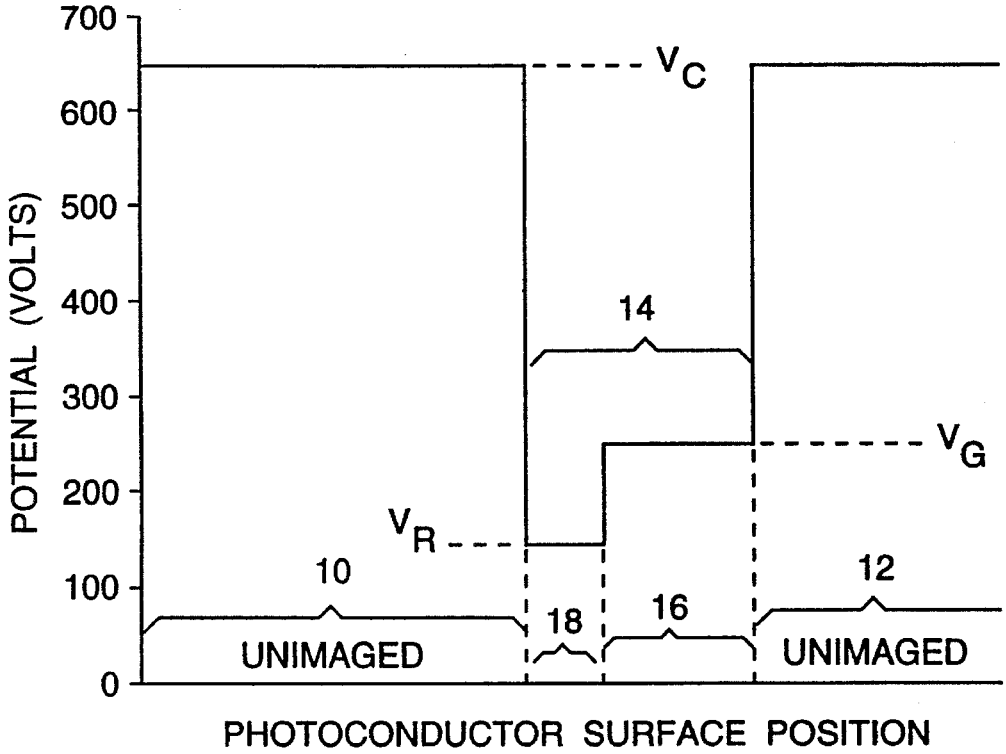
FIG. 2 is a simplified potential versus position plot of a photoconductor, illustrating the problem of ghosting due to a build-up in residual potential.

FIG. 2 is a potential versus position plot similar to that shown in FIG. 1, but illustrating the added problem of ghosting due to a build-up in residual electrostatic potential $V_R$. The build-up of residual potential $V_R$ occurs over a succession of imaging cycles during which trapped charge carriers accumulate within the photoconductor bulk upon discharge. The plot represents the electrostatic potential in nonimaged areas 10, 12 relative to imaged area 14, which has been discharged by imaging radiation. In particular, the plot represents the electrostatic potential in an imaged area 16 that has been subjected to a large number of previous discharge cycles relative to another imaged area 18 that has been subjected to a lesser number of previous discharge cycles. As shown in FIG. 2, the surface potential of imaged area 18 has dropped to a residual potential $V_R$. However, ghosting has occurred in imaged area 16 due to the accumulation of additional trapped charge carriers over a number of cycles and/or resulting generation of space-charge fields. Consequently, the surface potential in imaged area 16 has dropped only to a ghost potential $V_G$ relative to residual potential $V_R$. The ghost potential $V_G$, shown in FIG. 2 as approximately two-hundred and fifty (250) volts, not only reduces the contrast, and hence optical density, that can be achieved for toner deposition, but also creates a difference potential between imaged areas 16 and 18 that can lead to visible ghosting in the developed image.

FIGS. 3–6 are schematic cross-sectional representations of a photoconductor 20, illustrating mechanisms leading to the problems of residual potential and ghosting.

Figure 3:
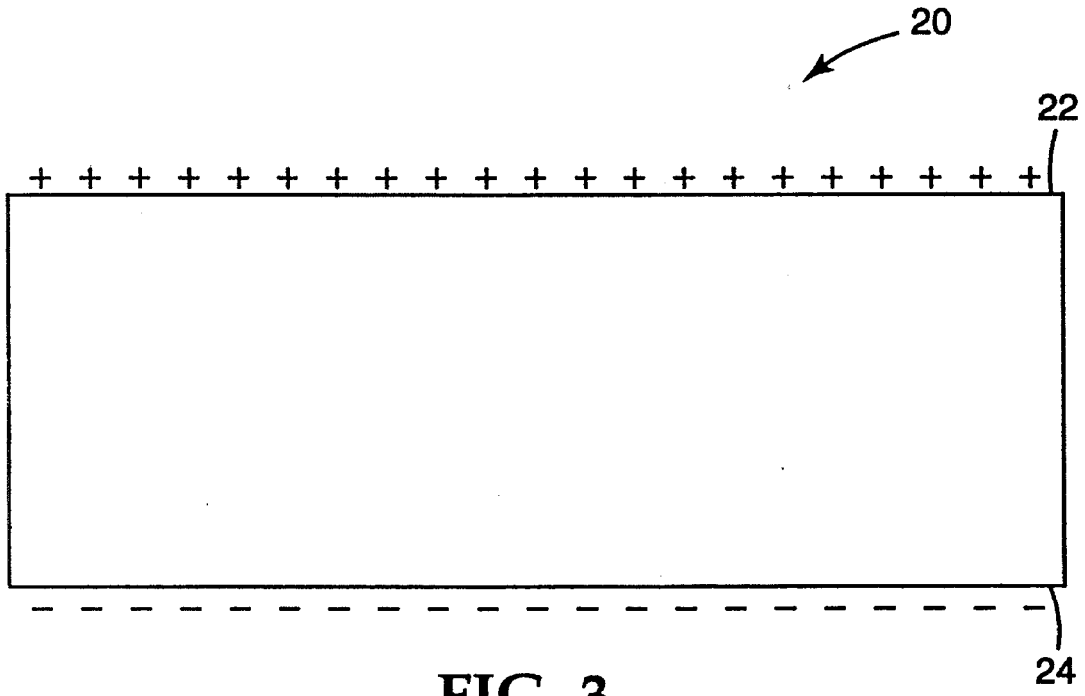
FIG. 3 is a schematic cross-sectional representation of a photoconductor after uniform surface charging.

FIG. 3 shows photoconductor 20 after uniform surface charging by a scorotron or other charge means such as a roller charging device. The photoconductor 20 has an imaging surface 22 to which the uniform surface charge is applied. After charging, a positive charge resides on the imaging surface 22 and a negative charge resides on a ground plane surface 24 of photoconductor 20.

Figure 4:
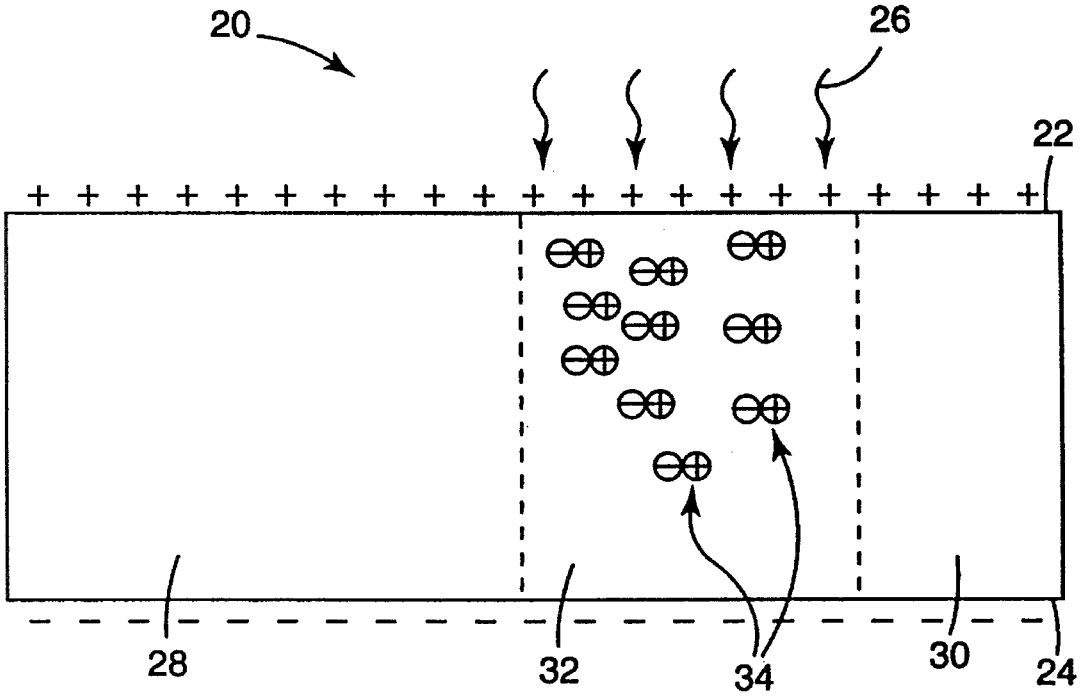
FIG. 4 is a schematic cross-sectional representation of the photoconductor of FIG. 3 during a first stage of image exposure.

FIG. 4 shows photoconductor 20 during a first stage of an image exposure operation. Imaging radiation 26 exposes imaging surface 22 to define unimaged areas 28 and 30, which maintain the initial surface potential, and imaged area 32, which is discharged to produce a discharge potential at imaging surface 22. The imaging radiation 26 creates electron-hole pairs 34 within the bulk or near surface of photoconductor 20 in imaged area 32. The charged potentials in unimaged areas 28 and 30 can be represented, for example, by those shown with respect to areas 10 and 12 in the plots of FIGS. 1 and 2. The discharged potential in imaged area 32 can be represented by that shown with respect to area 14 in the plots of either FIG. 1 or FIG. 2.

Figure 5:
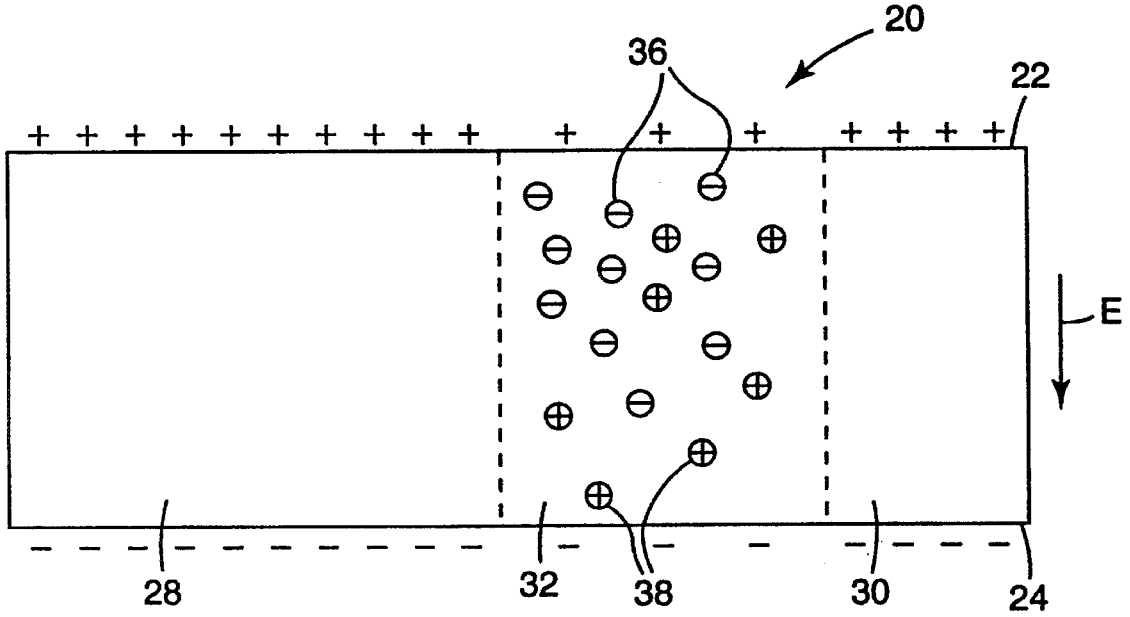
FIG. 5 is a schematic cross-sectional representation of the photoconductor of FIG. 3 during a second stage of image exposure.

As shown in FIG. 5, a fraction of electron-hole pairs 34 generated by imaging radiation 26 separate under the influence of an electric field existing between the positively-charged imaging surface 22 and the negatively-charged ground plane surface 24. The separated electron-hole pairs 34 produce electrons 36 and holes 38 that transport under the influence of the electric field toward imaging surface 22 and ground plane surface 24, respectively, thereby redistributing charge within photoconductor 20 to discharge the surface potential. Although holes 38 are generally more mobile than electrons 36 and transport more readily through photoconductor 20, both the holes and electrons contribute to redistribution of charge, and therefore will be generically referred to herein as "charge carriers."

Figure 6:
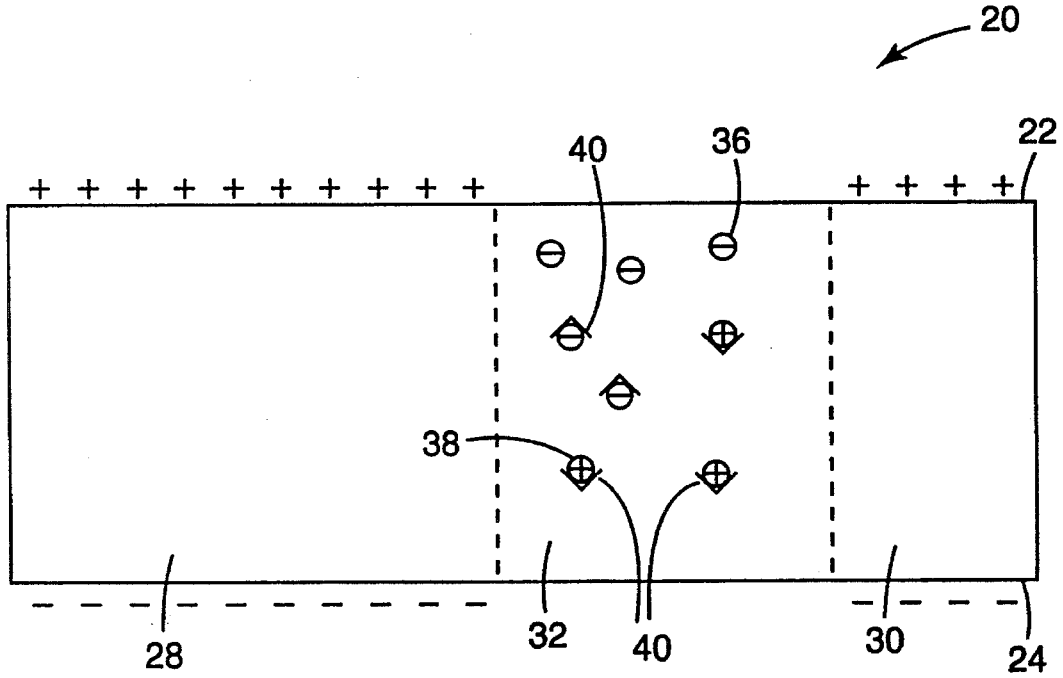
FIG. 6 is a schematic cross-sectional representation of the photoconductor of FIG. 3 after image exposure.

The redistribution of charge acts to discharge the surface potential of imaging surface 22 within imaged area 32. With reference to FIG. 6, however, not all of charge carriers 36, 38 transport through the width of photoconductor 20. Rather, some of charge carriers 36, 38 become trapped in trap sites 40 distributed throughout the bulk of photoconductor 20. The trapped charge carriers 36, 38 prevent the potential within imaged area 32 from falling to zero, as would be desirable for maximum contrast. Instead, charge carriers 36, 38 held in trap sites 40 support a residual potential $V_R$, as illustrated by the plot of FIG. 1, and may accumulate in trap sites over a number of image exposure cycles to produce ghosting problems, as illustrated in the plot of FIG. 2.

In accordance with the present invention, there is provided a system and method for reducing residual electrostatic potential in a photoconductor, such as photoconductor 20 of FIGS. 3–6. The system and method of the present invention apply a charge to imaging surface 22 of photoconductor 20 and expose the photoconductor to conditioning radiation having wavelengths selected to release charge carriers 36, 38 from trap sites 40 within the photoconductor. The applied charge establishes an electric field across photoconductor 20. The released charge carriers 36, 38 transport within photoconductor 20 under influence of the electric field to reduce residual electrostatic potential $V_R$ in the photoconductor. The electric field prevents re-trapping of the released charge carriers 36, 38 during transport by effectively sweeping them out of the bulk of photoconductor 20 to imaging surface 22 and ground plane surface 24, respectively. The resulting reduction in residual electrostatic potential $V_R$ increases optical density and eliminates ghosting problems in the subsequently developed image.

Figure 7:
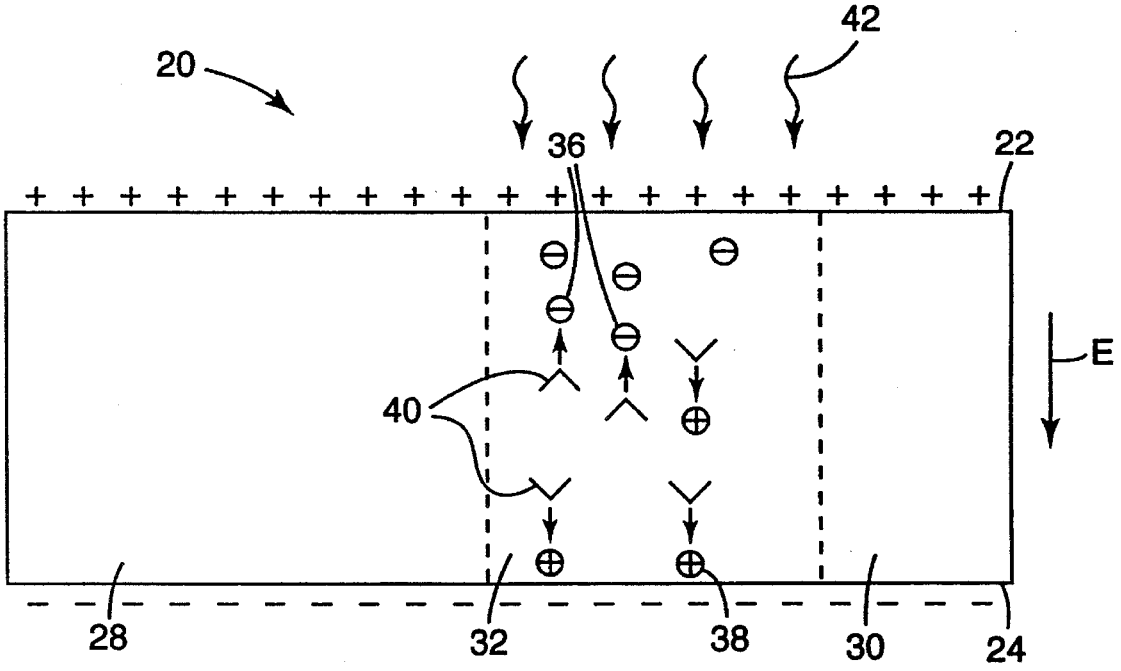
FIG. 7 is a schematic cross-sectional representation of the photoconductor of FIG. 6 during application of a system and method for reducing residual potential and ghosting, in accordance with the present invention.
Figure 8:
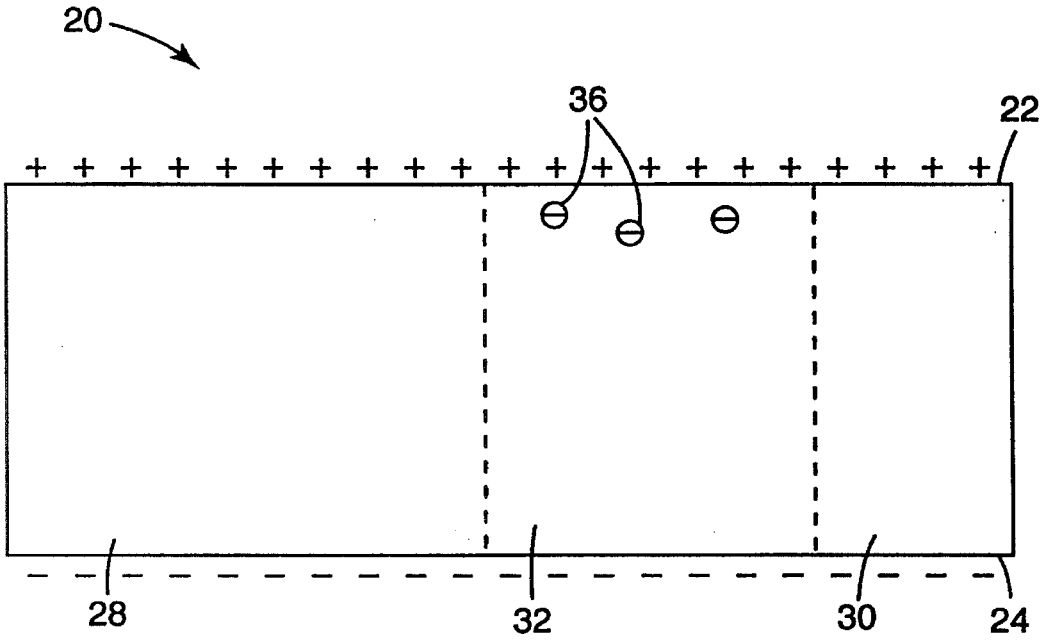
FIG. 8 is a schematic cross-sectional representation of the photoconductor of FIG. 6 after application of a system and method for reducing residual potential and ghosting, in accordance with the present invention.

FIG. 7 is a schematic cross-sectional representation of photoconductor 20 of FIG. 6 during application of the system and method of the present invention. The charge applied to imaging surface 22 produces an electric field E across the bulk of photoconductor 20. The conditioning radiation 42 has a wavelength selected to excite charge carriers 36, 38 out of their respective traps 40. Once released, charge carriers 36, 38 are swept out of photoconductor 20 to imaging surface 22 and ground plane surface 24, respectively, by the applied electric field E, thereby reducing the portion of the residual electrostatic potential $V_R$ attributable to trapped charge carriers. As shown in FIG. 8, photoconductor 20 may retain a small amount of immobile electrons 36, but otherwise is substantially free of trapped charge carriers 36, 38 capable of generating residual potential and/or ghost images in imaged area 32.

The conditioning radiation 42 includes wavelengths selected to release charge carriers 36, 38 held in trap sites 40, but preferably does not include wavelengths capable of discharging photoconductor 20. Wavelengths that discharge photoconductor 20 lead to generation of large numbers of new charge carriers that can flood photoconductor 20 and become trapped, compounding the problems of low optical density and ghosting. Therefore, the wavelength of conditioning radiation 20 is tuned to match known trap energies of the particular photoconductive material used. The tuned conditioning radiation 20 is selected to excite charge carriers 36, 38 out of their respective trap sites 36, but avoids significant generation of new, previously immobile charge carriers. Wavelengths overlapping the absorption band of the photoconductive material are filtered out of conditioning radiation 42, thereby suppressing discharge and the associated problems of added trapping.

The particular wavelengths selected for conditioning radiation 42 will vary with the type of photoconductive material used. Specifically, the selected wavelengths will vary with the absorption band exhibited by the photoconductive material used. In addition, the effectiveness of conditioning radiation 42 in reducing residual potential $V_R$ will be a function of other parameters including the intensity of the conditioning radiation, the time that photoconductor 20 is exposed to the conditioning radiation, and the strength of the applied electric field E. For example, the intensity of conditioning radiation 42 will determine the number of photons transmitted to photoconductor 20 per unit time, and hence the amount of trapped charge carriers 36, 38 released in the same unit time. The exposure time will determine the total number of photons transmitted by conditioning radiation 42 over the course of exposure with a given intensity, and hence the total amount of charge carriers 36, 38 released. The strength of the electric field E will then determine the ability of charge carriers 36, 38, once released, to transport through the bulk of photoconductor 20 to imaging surface 22 and ground plane surface 24, respectively. Thus, once an appropriate wavelength is selected for conditioning radiation 42, the above parameters may require adjustment for optimum results.

As discussed above, conditioning radiation 42 should include wavelengths greater than the absorption band of the particular photoconductive material to avoid discharge. Thus, with a photoconductive material having an absorption band of approximately four-hundred (400) to nine-hundred (900) nanometers, for example, conditioning radiation 42 having wavelengths in a range of approximately one-thousand (1000) to four-thousand five-hundred (4500) nanometers will release a sufficient number of trapped charge carriers. Such wavelengths fall in the near infrared and infrared range, which is well beyond the above absorption band. Use of near infrared and infrared wavelengths in the above range thereby avoids significant absorption that can lead to discharge and the generation of a large number of new charge carriers. Thus, conditioning radiation 42 is tuned to avoid the pitfalls of broad-spectrum erase lamps. Although conditioning radiation 42 should be tuned to wavelengths greater than the absorption band of the particular photoconductive material, it is conceivable that wavelengths falling within the absorption band may be tolerated to some extent, provided that intensities are small enough to avoid a large amount of discharge. Thus, a filter passing wavelengths falling within the absorption band nevertheless may be suitable if the peak of the filter pass band falls outside of the absorption band.

FIGS. *9a–11b* show various embodiments of the system of the present invention, and thus illustrate means by which the method of the present invention also can be implemented. The illustrated embodiments relate to use of the system in drum- and belt-based electrophotography machines, and therefore demonstrate examples of various photoconductor structures to which the principles of the present invention may be applied. In each embodiment, there is provided a charge means that applies a charge to a surface of the respective photoconductor, and a conditioning means that exposes the photoconductor to conditioning radiation having wavelengths selected to release charge carriers from trap sites within the photoconductor. The conditioning means can be provided by incorporating a dedicated source of conditioning radiation in the electrophotography machine. The charge means can be realized, however, by adaptation of hardware already present in the electrophotography machine, as will be described. The charge means thereby adds very little complexity, cost, size, or power consumption to the existing electrophotography machine.

FIG. *9a* is a schematic representation of an electrophotography machine 44 incorporating a first embodiment of the system of the present invention. The electrophotographic machine 44 includes a photoconductor 20 supported by a drum 46. The photoconductor 20 may be formed, for example, by coating a surface of drum 46 with photoconductive material, or by affixing a prefabricated photoconductor sheet or a plurality of photoconductor sheet sections to the surface of the drum. The drum 46 is coupled to a motor (not shown) that rotates the drum in a direction of travel during image exposure cycles.

The electrophotographic machine 44 further includes a set of imaging hardware positioned adjacent to imaging surface 22 of photoconductor 20. The imaging hardware includes, in order of position in the direction of travel of drum 46, a surface charge means 48 that applies a uniform surface potential to imaging surface 22 at the outset of an image exposure cycle, an image discharge means 50 that exposes the imaging surface to discharging radiation to define a latent image, and a development charge means 52 that applies a development bias potential to the imaging surface prior to the deposition of toner. The surface charge means 48 preferably comprises a scorotron having a corona wire shield, but could comprise a charging roller. The image discharge means 50 may comprise an imaging laser having a wavelength tuned to the absorption peak of photoconductor 20. The development charge means 52 comprises any charging device capable of delivering a development bias to imaging surface 22 and, in particular, may include a charging roller.

The first embodiment of the system of the present invention, as incorporated in electrophotographic machine 44 of FIG. *9a*, includes a charge means and a conditioning means. The charge means is conveniently provided by adaptation of the surface charge means 48 already present in electrophotography machine 44. Specifically, the scorotron of surface charge means 48 can be adapted by milling a slot 54 in corona wire shield 55. The conditioning means, identified by reference numeral 56, can then be realized by a conditioning radiation source 58 and filter 60 positioned proximate to the corona wire shield 55. A radiation shield 59 disposed proximate to filter 60 serves to block stray radiation emitted by radiation source 58. The conditioning means 56 is arranged such that the conditioning radiation produced by conditioning radiation source 58 passes through filter 60 and is passed through slot 54 of corona wire shield 55. The conditioning radiation is then received by imaging surface 22 of photoconductor 20. If a charging roller is employed for surface charge means 48, instead of a scorotron, a similar arrangement can be positioned proximate to the charging roller. For example, conditioning means 56 can be realized by conditioning radiation source 58, radiation shield 59, filter 60, and an additional opaque shield with a slot disposed adjacent the charging roller.

The corona wire shield 55 of scorotron 48 is made opaque in order to block the conditioning radiation, allowing it to strike photoconductor 20 through slot 54 only. As the conditioning radiation causes trapped charge carriers to be released within photoconductor 20, scorotron 48 simultaneously produces charging current that generates the electric field necessary to sweep the released charged carriers out of the photoconductor bulk. The current induced by scorotron 48 further provides a recharging effect that restores the surface charge of imaging surface 22 prior to imaging, in the event that any discharging occurs as a result of the release of trapped charge carriers.

With a photoconductor 20 having an absorption band in the range of approximately four-hundred (400) to nine-hundred (900) nanometers, for example, conditioning radiation source 58 can be provided by a linear filament (2700 Watt) quartz infrared lamp wired through a variac for power control. An example of a commercially available infrared quartz heater lamp having suitable output can be obtained, with reference to catalog number QIH-2500, from The Second Source, La Verne, Calif. The radiation emitted by the lamp can then be passed through filter 60 to limit transmission to a range of approximately one-thousand (1000) to four-thousand five-hundred (4500) nanometers, thereby avoiding wavelengths capable of appreciably discharging photoconductor 20. An example of a commercially available filter having suitable spectral characteristics can be obtained, with reference to catalog number 59562, from Oriel Corporation, of Stratford, Conn. The specifications of lamp 58 and filter 60 will be appropriate for reduction of residual potential in photoconductive materials having similar absorption versus wavelength characteristics. The commercially available filter 60 referenced above is substantially circular in shape. The slot 54 preferably has a narrow, elongated shape and extends transverse to the direction of travel of photoconductor imaging surface 22. Although the opaque corona wire shield 55 will block radiation passed through the circular filter 60 that falls outside of the narrow slot 54, it may be desirable to customize the filter to conform to the shape and size of the slot.

Figure 9A:
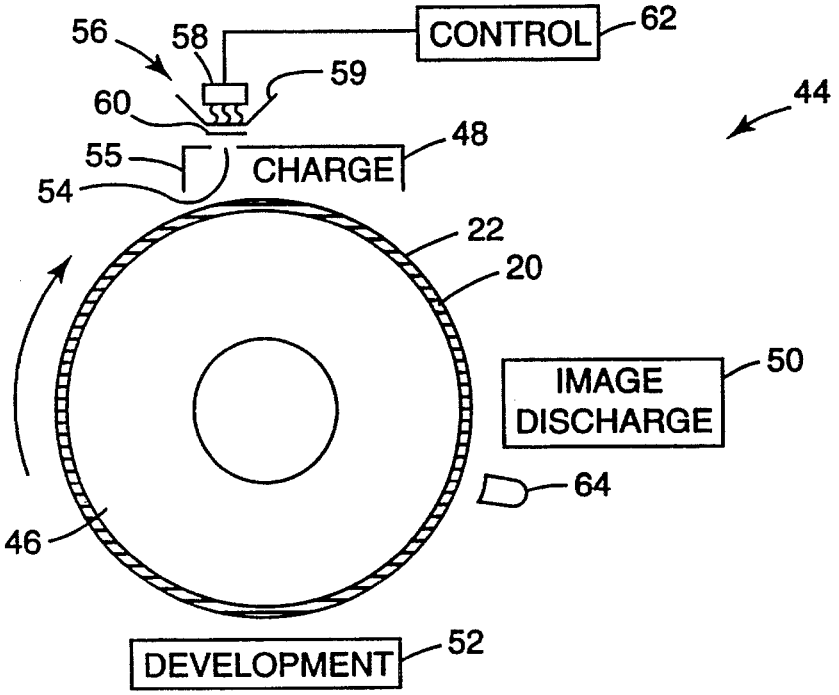
FIG. 9*a* is a schematic representation of a drum-based electrophotography machine incorporating a first embodiment of a system and method for reducing residual potential and ghosting in a photoconductor, in accordance with the present invention.

As also shown in FIG. 9*a*, the system of the present invention further includes a control means 62 for controlling the activation of conditioning means 56. The control means 62 may comprise a microprocessor programmed to control activation of driver circuitry associated with conditioning means 56 in response to predetermined criteria. Although conditioning means 56 may remain active throughout the imaging exposure process, continuous conditioning of photoconductor 20 is considered unnecessary. Rather, the conditioning technique can be applied on a less frequent basis as a treatment when residual potential approaches a problematic level that adversely affects optical density and/or produces ghosting. Thus, control means 62 may be configured, in an open-loop manner, to repeat the steps of applying charge and exposing photoconductor 20 to conditioning radiation in response to elapse of a predetermined period of nonuse during which the residual potential can climb to an undesirable level. Alternatively, control means 62 can be configured in a similar open-loop manner to repeat the charging and exposing steps in response to elapse of a predetermined period of time. As a further alternative, control means 62 can be configured in a closed-loop manner to repeat the charging and exposing steps in response to a measurement of the actual residual potential that exceeds a predetermined threshold, as measured by an electrostatic probe 64 positioned proximate to imaging surface 22.

Figure 9B:
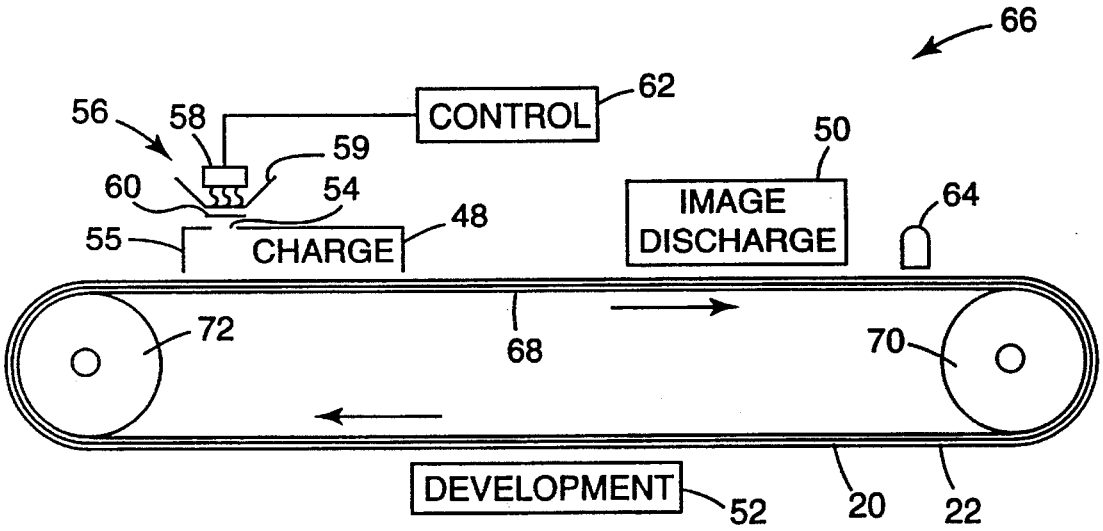
FIG. 9*b* is a schematic representation of a belt-based electrophotography machine incorporating the first embodiment of a system and method for reducing residual potential and ghosting in a photoconductor, in accordance with the present invention.

FIG. 9*b* is a schematic representation of a belt-based electrophotography machine 66 incorporating the first embodiment of a system for reducing residual potential in a photoconductor, in accordance with the present invention. The electrophotography machine 66 substantially corresponds to that shown in FIG. 9*a*, but includes a belt 68 mounted on a pair of rollers 70, 72. The belt 68 carries photoconductor 20 and moves under power of a motor (not shown) coupled to either roller 70 or 72. The belt 68 moves in a direction of travel relative to the imaging hardware provided by surface charge means 48, imaging discharge means 50, and development charge means 52. As in FIG. 9*a*, surface charge means 48 and conditioning means 56 are positioned proximate to imaging surface 22 of photoconductor 20, and provided in an integral arrangement with the conditioning means emitting conditioning radiation through slot 54 of the charge means.

Figure 10A:
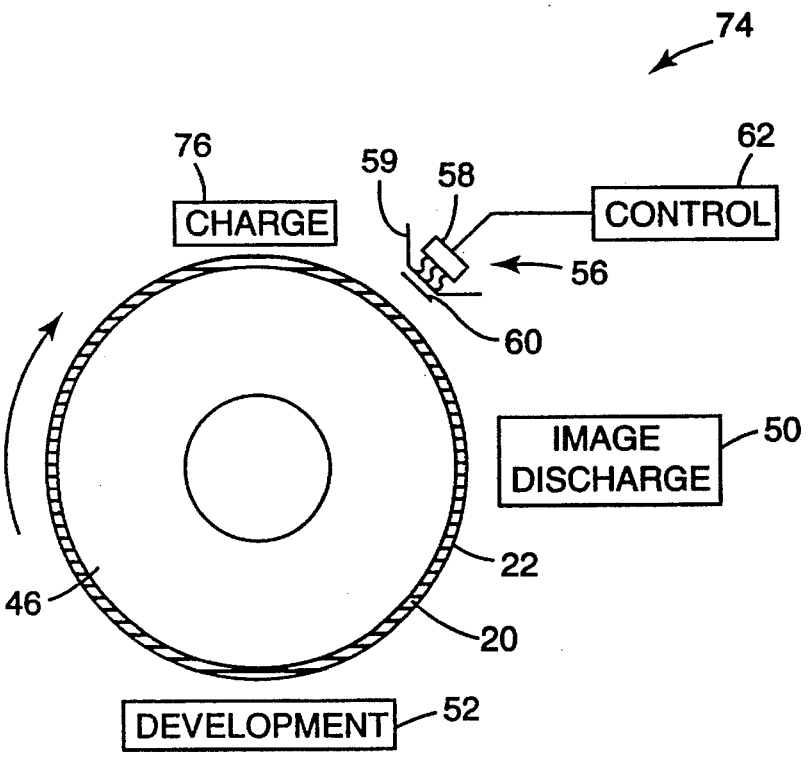
FIG. 10*a* is a schematic representation of a drum-based electrophotography machine incorporating a second embodiment of a system and method for reducing residual potential and ghosting in a photoconductor, in accordance with the present invention.

FIG. 10*a* is a schematic representation of a drum-based electrophotography machine 74 incorporating a second embodiment of a system for reducing residual potential in a photoconductor, in accordance with the present invention. The electrophotography machine 74 substantially corresponds to that shown in FIG. 9*a*. However, conditioning means 56 is positioned between a surface charge means 76, comprising a scorotron or charging roller, and imaging discharge means 50, relative to the direction of travel of drum 46. In this case, the scorotron or charging roller of surface charge means 76 still functions as the charge means of the present invention, but does not include a slot for transmission of the conditioning radiation. Rather, conditioning means 56 transmits conditioning radiation to imaging surface 22 at a point following application of the charge by charge means 76, thereby releasing trapped charge carriers. Although the conditioning radiation is applied after the corona current from the scorotron, the applied surface charge nevertheless maintains the electric field necessary to sweep the released charge carriers out of photoconductor 20. Because the conditioning radiation is tuned to the relevant trap energies, and therefore preferably comprises only wavelengths that fall outside of the absorption band for photoconductor 20, substantially no discharge occurs prior to rotation of drum 46 to the position of imaging discharge means 50. As a result, the uniform surface charge on imaging surface 22 is preserved for the formation of a latent image by the imaging laser.

Figure 10B:
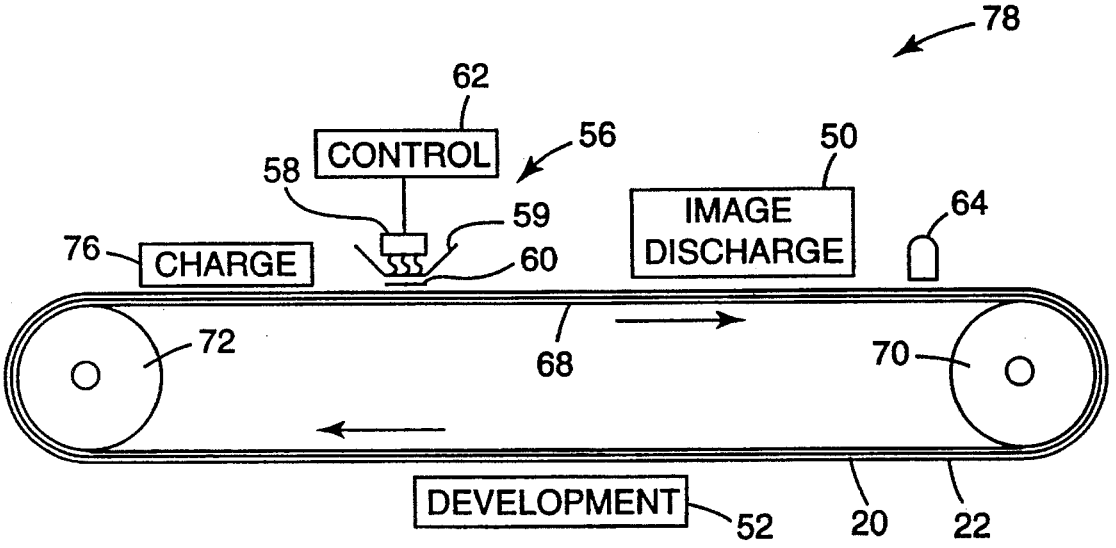
FIG. 10*b* is a schematic representation of a belt-based electrophotography machine incorporating the second embodiment of a system and method for reducing residual potential and ghosting in a photoconductor, in accordance with the present invention.

FIG. 10*b* is a schematic representation of a belt-based electrophotography machine 78 incorporating the second embodiment of a system for reducing residual potential in a photoconductor, in accordance with the present invention. The electrophotography machine 78 substantially corresponds to that shown in FIG. 10*a*, but includes a belt 68 mounted on rollers 70, 72. The belt 68 carries photoconductor 20 and moves under power of a motor (not shown) coupled to either roller 70 or 72. The belt 68 moves in a direction of travel relative to the imaging hardware provided by surface charge means 76, imaging discharge means 50, and development charge means 52. As in FIG. 10*a*, conditioning means 56 is positioned proximate to imaging surface 22 between surface charge means 76 and imaging discharge means 50, and therefore follows application of the uniform surface charge to the imaging surface.

Figure 11A:
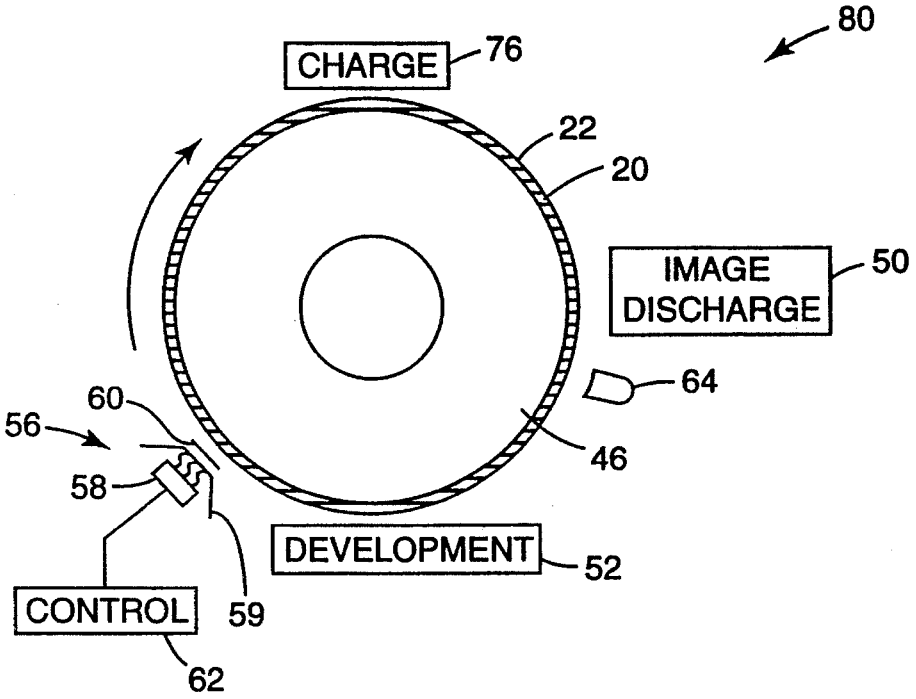
FIG. 11*a* is a schematic representation of a drum-based electrophotography machine incorporating a third embodiment of a system and method for reducing residual potential and ghosting in a photoconductor, in accordance with the present invention.

FIG. 11*a* is a schematic representation of a drum-based electrophotography machine 80 incorporating a third embodiment of a system for reducing residual potential in a photoconductor, in accordance with the present invention. The electrophotography machine 80 substantially corresponds to that shown in FIG. 9*a*. However, conditioning means 56 is positioned after development charge means 52 and before surface charge means 76, comprising the scorotron or charging roller, relative to the direction of movement of drum 46. It may be important to also position conditioning means 52 before the toner transfer means (not shown) associated with electrophotography machine 80 for application of conditioning radiation prior to alteration of the electric field by the toner transfer means. In this third embodiment, the charge means is provided not by surface charge means 76, but by development charge means 52, which applies the development bias potential necessary for toner development. The conditioning means 56 exposes imaging surface 22 to conditioning radiation at a position following the development of the latent image by development charge means 52. The development bias potential maintains a field that is sufficient to sweep the charge carriers released by the conditioning radiation out of photoconductor 20.

Figure 11B:
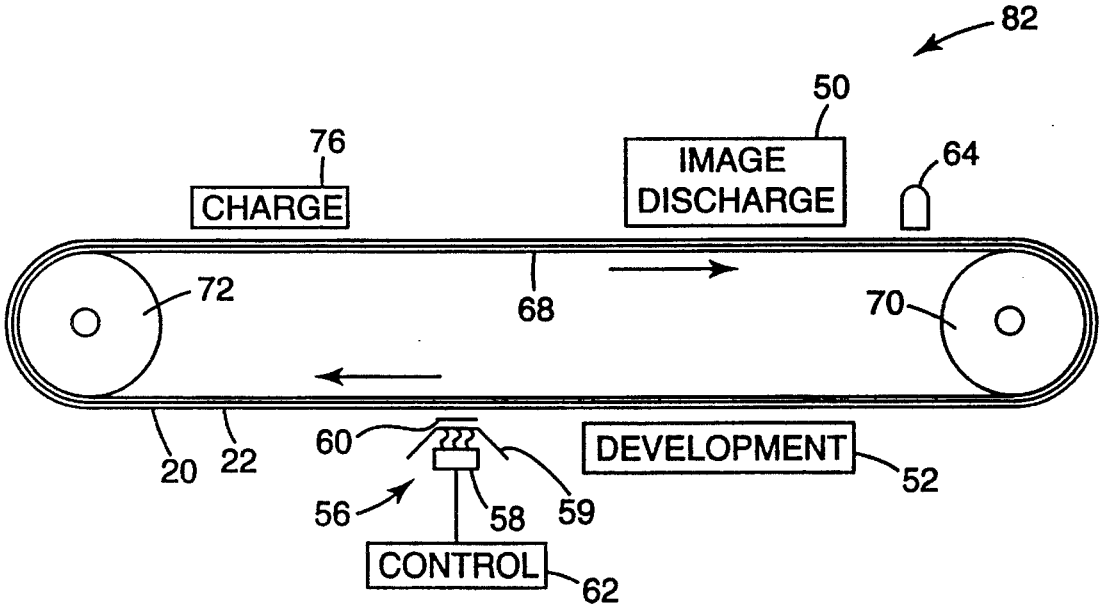
FIG. 11*b* is a schematic representation of a belt-based electrophotography machine incorporating the third embodiment of a system and method for reducing residual potential and ghosting in a photoconductor, in accordance with the present invention.

FIG. 11*b* is a schematic representation of a belt-based electrophotography machine 82 incorporating a system for reducing residual potential in the photoconductor, in accordance with the present invention. The electrophotography machine 82 substantially corresponds to that shown in FIG. 11*a*, but includes belt 68 mounted on rollers 70, 72. As in FIG. 11*a*, conditioning means 56 is positioned proximate to imaging surface 22 between development charge means 52 and surface charge means 76, relative to a direction of travel of belt 68. The conditioning radiation therefore follows application of the development bias potential by development charge means 52, which functions as the charge means. Again, it may be important to position conditioning means 52 before the toner transfer means (not shown) associated with electrophotography machine 80 for application of conditioning radiation prior to alteration of the electric field by the toner transfer means.

Figure 12A:
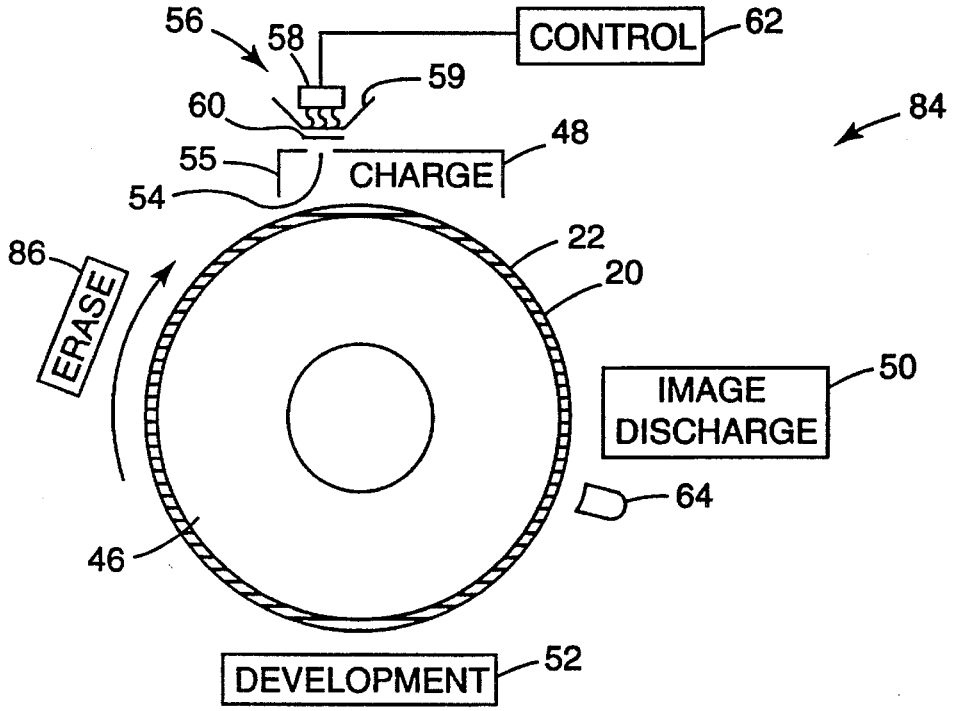
FIG. 12*a* is a schematic representation of a drum-based electrophotography machine incorporating a fourth embodiment of a system and method for reducing residual potential and ghosting in a photoconductor, in accordance with the present invention.

FIG. 12*a* is a schematic representation of a drum-based electrophotography machine 84 incorporating a fourth embodiment of a system for reducing residual potential in a photoconductor, in accordance with the present invention. The electrophotography machine 84 shown in FIG. 12*a* substantially corresponds to that shown in FIG. 9*a*, but may correspond to any of the electrophotography machines shown in FIGS. 9*a*, 10*a*, or 11*a*. The distinction between the electrophotography machine 84 of FIG. 12*a* is the incorporation of an erase lamp 86. As shown in FIG. 12*a*, erase lamp 86 may be positioned after development charge means 52 and before surface charge means 48, relative to the direction of movement of drum 46. In this fourth embodiment, erase lamp 86 exposes imaging surface 22 to broad-spectrum erase radiation that uniformly generates charge carriers and discharges imaging surface 22 immediately prior to application of surface charge means 48. The conditioning means 56 exposes imaging surface 22 to conditioning radiation in the presence of the field induced by charge means 48. The field is sufficient to sweep the charge carriers generated by conditioning means 56 out of photoconductor 20.

Figure 12B:
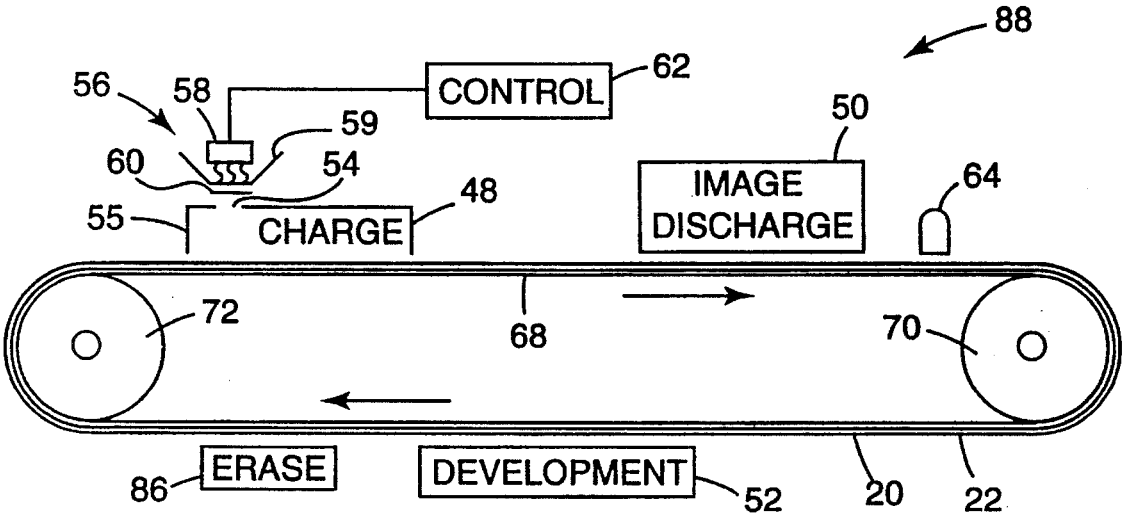
FIG. 12*b* is a schematic representation of a belt-based electrophotography machine incorporating the fourth embodiment of a system and method for reducing residual potential and ghosting in a photoconductor, in accordance with the present invention.

FIG. 12*b* is a schematic representation of a belt-based electrophotography machine 88 incorporating a system for reducing residual potential in the photoconductor, in accordance with the present invention. The electrophotography machine 88 substantially corresponds to that shown in FIG. 12*a*, but includes belt 68 mounted on rollers 70, 72. As in FIG. 12*a*, erase lamp 86 is positioned proximate to imaging surface 22 between development charge means 52 and charge means 48, relative to a direction of travel of belt 68.

The following non-limiting examples are provided to further illustrate the system and method of the present invention, and, in particular, the effectiveness of the system and method of the present invention in reducing electrostatic potential in a photoconductor. The ring coating process used in the following examples is described in Borsenberger, P. S. and D. S. Weiss, *Organic Photoreceptors for Imaging Systems*, Marcel Dekker, Inc., New York, 1993, p. 294.

EXAMPLE 1

This example illustrates the effect of the position and type of the conditioning means on the depth of residual potential in an organic photoconductor.

An organic photoconductor was prepared using the following coating solution:

| | |
|---|---|
| X-form metal-free Phthalocyanine pigment (available from ICI Specialities) | 6.4 g |
| Butvar® B-76 (polyvinyl butyral available from Monsanto Co.) | 32.0 g |
| CAO-5 (2,2'-methylene-bits-6-(t-butyl)-p-cresol, available from Sherwin-Williams) | 1.6 g |
| Tetrahydrofuran | 365.0 g |

The Butvar® B-76 resin was dissolved in tetrahydrofuran followed by the addition of the remaining ingredients and 680 g of yellow ceramic beads in a 32 ounce glass jar. The mixture was placed on a roller mill at 60 revolutions-per-minute for 48 hours. The solution was decanted off of the ceramic beads and then coated onto an aluminum vapored coated 0.1 mm (4 mil) polyester substrate at a 100 micron wet thickness, using a #40 Meyer rod. The coated substrate was air dried at room temperature for 5 minutes, followed by heating in a convection oven at 90° C. for 2 hours.

The residual potential on the organic photoconductor surface was compared using two different conditioning means configurations. In one configuration, the corona charging device used was a scorotron equipped with an illumination slot. The infrared (IR) lamp utilized was a linear filament 2700 watt quartz infrared (IR) lamp equipped with a bandpass filter, allowing transmission only between one-thousand (1000) and four-thousand five-hundred (4500) nanometers. Other wavelengths were blocked from the photoconductor by a copper shield positioned around the lamp and filter. In another configuration, the IR lamp, filter, and shield arrangement was positioned between the scorotron and the imaging device.

When the organic photoconductor was exposed to a standard 715 nanometer erase lamp positioned between the development station and the scorotron, a residual potential of approximately two-hundred and fifty (250) volts was recorded. However, when the organic photoconductor was exposed with a filtered IR lamp illuminating through the scorotron or between the scorotron and the imaging device, a lower residual potential of approximately one-hundred and forty (140) volts was observed.

EXAMPLE 2

This example illustrates the effect of IR irradiation on the surface electrostatic potential of a discharged imaged organic photoconductor.

A photoconductive drum, comprising an aluminum drum, organic photoconductive layer, barrier layer and release layer, was prepared as follows:

| Organic Photoconductive layer coating solution: | |
|---|---|
| Millbase: | |
| X-form metal free Phthalocyanine pigment (available from Zeneca Corp.) | 100 g |
| EC-130 (vinyl chloride copolymer, available from Sekisui; 15% by weight in tetrahydrofuran) | 400 g |
| Mowital B60HH (polyvinylbutyral resin, available from Hoechst Celanese; 15% by weight in tetrahydrofuran) | 600 g |
| Tetrahydrofuran | 1000 g |

The materials listed above were mixed together in a 1 gallon glass bottle. The mixture was then milled in a 250 mL horizontal sandmill with 0.8 mm ceramic milling media for 24 hours at a rotor speed of 4,000 rpm.

A coating solution was then prepared by mixing the following materials:

| | |
|---|---|
| Millbase prepared above (12.4% by weight in THF) | 300 g |
| Tinuvin-770 (UV stabilizer available from Ciba Geigy) | 2.2 g |
| Mowital B60HH (polyvinylbutyral resin, available from Hoechst Celanese) | 296 g |
| Tetrahydrofuran (THF) | 132 g |
| Propyleneglycolmonomethyl ether acetate (PMAc) | 79 g |

The materials listed above were mixed thoroughly together and filtered through a 5 micron filter (available from Porous Media Corp.). Just prior to coating, 1.05 g of Mondur CB-601 (60% T.S. Toluene diisocyanate, available from Mobay Corp.), 0.03 g of Dibutyl tin dilaurate catalyst (available from Aldrich) and 10 g of THF were added to 140 g of the filtered solution described above. The final coating solution was then ring-coated onto a polished, clean aluminum drum and air dried at 150° C. for 2 hours, resulting in a dry coating weight of 7.5 microns.

| Barrier Layer coating solution: | |
|---|---|
| Butvar ™ B-98 (polyvinylbutral, available from Monsanto) | 2.4 g |
| Isopropyl alcohol | 57.6 g |
| Nalco ™ 1057 (14.5% colloidal silica in water, available from Nalco Chemical) | 16.0 g |
| Triton ™ X-100 (Octylphenoxypolyethoxyethanol, available from Union Carbide Chemicals & Plastics Co. 10% by weight in water) | 2.0 g |
| Deionized water | 64.0 g |
| Ethanol | 80.0 g |
| 3-Glycidoxypropyltrimethoxysilane (5% prehydrolyzed, available from Huls America) | 10.0 g |

The above ingredients were combined in the order listed. The solution was agitated on a shaker table for 30 minutes, stirred and then allowed to stand for 24 hours. The coating solution was coated onto the photoconductor described above using a ring coating process. The coating was then cured at 125° C. for 30 minutes to give a dry coating thickness of 0.4 micron.

| Release Layer coating solution: | |
|---|---|
| Vinylmethyl dimethylsiloxane copolymer (trimethylsiloxy terminated having a 27.6 mole % vinylmethyl; 15% by weight in heptane) | 3.8 g |
| NM203 (polymethylhydrosiloxane, available from Huls America) | 0.2 g |
| Heptane | 20.0 g |
| C-158 (vinylmethyl dimethylsiloxane copolymer, trimethylsiloxy terminated having 0.2 mole % vinylmethyl, available from Wacker Silicones) | 1.2 g |
| Platinum catalyst (1% by weight chloroplatinic acid based hydrosilylation catalyst in heptane) | 0.4 g |

General preparations of the vinylmethyl dimethylsiloxane copolymers can be found in Yilgor I. and J. E. McGrath, *Adv. Polym. Sci.*, Springer-Verlag Berlin Heidelberg New York, 86, 1988, p. 1.

The above ingredients were combined in the order listed. The coating solution was ring coated onto the barrier layer described above. The coating was then placed in an 150° C. oven for 45 minutes to give a dry coating thickness of 0.7 micron.

The imaging process consisted of imaging the organic photoconductor using a 780 nanometer laser diode scanner to discharge selected areas of the photoconductor. The electrostatic latent image was toned with a magenta liquid toner. The toned images were transferred off the photoconductor onto a receptor or other suitable means for image transfer to a receptor. The organic photoconductor was then transported beneath the scorotron to recharge the photoconductor to begin the next imaging cycle. The imaging cycle was repeated several times with no near infrared/infrared radiation conditioning.

A new image cycle was then performed to measure optical density and test for ghosts. This cycle consisted of uniform exposure by imaging radiation across both the previously imaged and non-imaged areas of the recharged organic photoconductor. After development and transfer to paper, the optical density of the toned image was measured. In the previously imaged areas, the optical densities of the reproduced toned image increased from 0.45 to 0.68 upon treatment of the photoconductor with near infrared/infrared radiation. In the previously non-imaged areas, the optical densities of the reproduced toned image increased from 0.60 to 0.68 upon treatment of the photoconductor with near infrared/infrared radiation. The optical densities were measured using a Gretag SPM50 densitometer set to NCT standards.

The near infrared and infrared radiation treatment can be accomplished by illuminating the photoconductor with IR radiation either through the scorotron or between the scorotron and the imaging device. Both methods gave rise to the same average results.

Having described the exemplary embodiments of the invention, additional advantages and modifications will readily occur to those skilled in the art from consideration of the specification and practice of the invention disclosed herein. Therefore, the specification and examples should be considered exemplary only, with the true scope and spirit of the invention being indicated by the following claims.

What is claimed is:

1. A method for reducing residual electrostatic potential in a photoconductor, said method comprising the steps of:

applying a charge to a surface of said photoconductor, said charge establishing an electric field across said photoconductor; and exposing said photoconductor to conditioning radiation having wavelengths selected to release charge carriers from trap sites within said photoconductor, wherein said conditioning radiation consists essentially of conditioning radiation having wavelengths greater than an absorption band of said photoconductor, the released charge carriers being transported within said photoconductor under influence of said electric field to reduce residual electrostatic potential in said photoconductor, wherein said photoconductor moves in a direction of travel during an imaging cycle, and said step of exposing includes exposing said photoconductor at a position after a position at which said charge is applied and before a position at which image discharge radiation is applied to said photoconductor relative to said direction of travel of said photoconductor during said imaging cycle.

2. The method of claim 1, wherein said step of applying said charge includes applying said charge via a scorotron positioned proximate to said surface of said photoconductor.

3. The method of claim 1, wherein said step of applying said charge includes applying said charge via a development charge means positioned proximate to said surface of said photoconductor.

4. The method of claim 1, wherein said conditioning radiation consists essentially of conditioning radiation having wavelengths greater than or equal to approximately one-thousand (1000) nanometers.

5. The method of claim 1, wherein said conditioning radiation consists essentially of conditioning radiation having wavelengths in a range of approximately one-thousand (1000) to four-thousand five-hundred (4500) nanometers.

6. The method claim 1, wherein said step of exposing said photoconductor includes exposing said photoconductor via a conditioning radiation source positioned proximate to said surface of said photoconductor, said conditioning radiation source emitting said conditioning radiation via a filter.

7. The method of claim 1, wherein said photoconductor is a photoconductor drum.

8. The method of claim 1, wherein said photoconductor is a photoconductor belt.

9. The method of claim 1, wherein said photoconductor includes an organic photoconductive material.

10. The method of claim 1, wherein said photoconductor includes an inorganic photoconductive material.

11. The method of claim 1, further comprising the step of repeating the steps of applying said charge and exposing said photoconductor in response to elapse of a predetermined period of nonuse of said photoconductor.

12. The method of claim 1, further comprising the step of repeating the steps of applying said charge and exposing said photoconductor in response to elapse of a predetermined period of time.

13. The method of claim 1, further comprising the steps of measuring a residual electrostatic potential of said photoconductor, and repeating the steps of applying said charge and exposing said photoconductor when the measured residual electrostatic potential exceeds a predetermined threshold.

14. A system for reducing residual electrostatic potential in a photoconductor, said system comprising:

charge means for applying a charge to a surface of said photoconductor, said charge establishing an electric field across said photoconductor;

conditioning means for exposing said photoconductor to conditioning radiation having wavelengths selected to release charge carriers from trap sites within said photoconductor, wherein said conditioning radiation consists essentially of conditioning radiation having wavelengths greater than an absorption band of said photoconductor, the released charge carriers being transported within said photoconductor under influence of said electric field to reduce residual electrostatic potential in said photoconductor, an image discharge means, positioned proximate to said surface of said photoconductor, for exposing said photoconductor to discharging radiation to define a latent image on said photoconductor, wherein said photoconductor moves in a direction of travel during an imaging cycle, and said conditioning means is positioned after said charge means and before said image discharge means relative to said direction of travel of said photoconductor during said imaging cycle.

15. The system of claim 14, wherein said charge means includes a scorotron means positioned proximate to said surface of said photoconductor.

16. The system of claim 14, wherein said charge means includes a development charge means positioned proximate to said surface of said photoconductor.

17. The system of claim 14, wherein said conditioning means emits conditioning radiation consisting essentially of wavelengths greater than or equal to approximately one-thousand (1000) nanometers.

18. The system of claim 14, wherein said conditioning means emits conditioning radiation consisting essentially of wavelengths in a range of approximately one-thousand (1000) to four-thousand five-hundred (4500) nanometers.

19. The system claim 14, wherein said conditioning means includes a conditioning radiation source positioned proximate to said surface of said photoconductor, and a filter positioned proximate to said conditioning radiation source, said conditioning radiation source emitting said conditioning radiation via said filter.

20. The system of claim 14, wherein said photoconductor is a photoconductor drum.

21. The system of claim 14, wherein said photoconductor is a photoconductor belt.

22. The system of claim 14, wherein said photoconductor includes an organic photoconductive material.

23. The system of claim 14, wherein said photoconductor includes an inorganic photoconductive material.

24. The system of claim 14, further comprising control means for activating said conditioning means in response to elapse of a predetermined period of nonuse of said photoconductor.

25. The system of claim 14, further comprising control means for activating said conditioning means in response to elapse of a predetermined period of time.

26. The system of claim 14, further comprising means for measuring a residual electrostatic potential of said photoconductor, and control means for activating said conditioning means when the measured residual electrostatic potential exceeds a predetermined threshold.

27. A method for reducing residual electrostatic potential in a photoconductor, said method comprising the steps of:

applying a charge to a surface of said photoconductor, said charge establishing an electric field across said photoconductor;

exposing said photoconductor to conditioning radiation having wavelengths selected to release charge carriers from trap sites within said photoconductor, the released charge carriers being transported within said photoconductor under influence of said electric field to reduce residual electrostatic potential in said photoconductor; and measuring a residual electrostatic potential of said photoconductor, and repeating the steps of applying said charge and exposing said photoconductor when the measured residual electrostatic potential exceeds a predetermined threshold.

* * * * *